US006367672B1

(12) United States Patent
Lind

(10) Patent No.: US 6,367,672 B1
(45) Date of Patent: Apr. 9, 2002

(54) CELLULAR/PORTABLE PHONE HOLDER

(75) Inventor: Harvey Lind, deceased, late of Calgary (CA), by legal representative Sharon McGowan

(73) Assignee: Sur Grip Holsters, Limited, Calgary (CA)

( * ) Notice: Subject to any disclaimer, the term of this patent is extended or adjusted under 35 U.S.C. 154(b) by 0 days.

(21) Appl. No.: 09/542,515

(22) Filed: Apr. 3, 2000

(51) Int. Cl.[7] ..... A45F 5/00

(52) U.S. Cl. ..... 224/245; 224/901.8; 224/930; 224/676; D3/218

(58) Field of Search ..... 224/231, 232, 224/234, 235, 240, 242, 245, 930, 901.8, 904, 666, 676; 150/130, 103; 190/110, 127; D3/218

(56) References Cited

U.S. PATENT DOCUMENTS

| | | | | | |
|---|---|---|---|---|---|
| 1,074,685 | A | * | 10/1913 | Batchelder | 224/231 |
| 2,700,492 | A | * | 1/1955 | Baetzing | 224/245 X |
| 3,415,300 | A | * | 12/1968 | Worcester | |
| D232,135 | S | * | 7/1974 | Dodson | 224/240 X |
| 3,949,916 | A | * | 4/1976 | Yount | 224/240 |
| 4,083,321 | A | * | 4/1978 | LeBron et al. | |
| D288,865 | S | * | 3/1987 | Nace | D3/218 |
| 4,733,776 | A | | 3/1988 | Ward | |
| 4,771,927 | A | | 9/1988 | Ventura | |
| 4,811,768 | A | | 3/1989 | Williams | |
| 4,821,933 | A | * | 4/1989 | Seber | 224/904 X |
| 4,874,119 | A | * | 10/1989 | Winter | 190/110 X |
| 5,009,319 | A | * | 4/1991 | Jantzen | 150/130 X |
| 5,020,711 | A | | 6/1991 | Kelley | |
| 5,351,868 | A | * | 10/1994 | Beletsky et al. | 224/245 |
| 5,395,023 | A | | 3/1995 | Naymark et al. | |
| 5,433,359 | A | | 7/1995 | Flowers | |
| 5,526,924 | A | | 6/1996 | Klutznick | |
| D377,117 | S | * | 1/1997 | Klassen | D3/218 |
| 5,711,469 | A | | 1/1998 | Gormley et al. | |
| 5,816,459 | A | * | 10/1998 | Armistead | 224/930 X |
| 5,890,636 | A | * | 4/1999 | Kibbe | 224/901.8 X |
| 5,938,089 | A | | 8/1999 | Abreu-Marston | |
| 6,068,095 | A | * | 5/2000 | Glembocki et al. | 150/130 X |

* cited by examiner

*Primary Examiner*—Gregory M. Vidovich
(74) *Attorney, Agent, or Firm*—Gene Scott-Patent Law & Venture Group

(57) ABSTRACT

The present invention provides a combination comprising a storage pouch constructed from a single piece of flexible sheet material folded to form a front panel, left side panel, right side panel, rear panel and a bottom panel, the bottom panel joining the front and rear panels, and the front and rear panels joined at corresponding laterally positioned and spaced apart panel edges. A first surface attachment means is fixed to an inside surface of the storage pouch. A hand-held communication device is an additional part of the combination, this communication device is adapted by size for fitting into the storage pouch, with a space between the front panel of the storage pouch and the front surface of the communication device, and a space between the rear panel of the storage pouch and the rear surface of the communication device.

8 Claims, 1 Drawing Sheet

CELLULAR/PORTABLE PHONE HOLDER

BACKGROUND OF THE INVENTION

1. Field of the Invention

This invention relates generally to holders for cellular or portable phones, and more particularly to a holder that will secure such a portable device without the need for an upper closure flap.

2. Description of Related Art

The following art defines the present state of this field:

Kelley et. al U.S. Pat. No. 5,020,711 describes a holder for reusable hot/cold packs used topically for the thermo treatment of muscle injuries, aches, inflammations and the like. Each holder is capable of accepting and retaining a corresponding thermo pack. The holder/thermo pack may be used singularly or combined with one or more like holder/thermo packs using a number of corresponding hook and loop strips for treating larger injury areas. One or more elastic bands, affixed at one end to the holder, wrap around the portion of the body being treated, and attach again to the holder by means of a hook and loop fastener system. If the attached elastic bands are not of sufficient length to completely wrap around the treatment area, additional elastic bands of greater length, with hook and loop fasteners on each end, are used and attached to either the holder or an elastic band.

Williams et. al. U.S. Pat. No. 4,811,768 describes a security pouch of a size adapted to hold a cash receipts container in a vertical position and adapted to be worn by an individual suspended from the shoulder and adjacent the side of the individual's chest and under the individual's arm, including an opening provided with a closure that is operable by one hand.

Ventura et. al. U.S. Pat. No. 4,771,927 describes a phone holder connectable around the mid portion of a cordless remote-use type telephone handset, including an elongated flexible strap having mating releasable Velcro-type interconnecting devices at each end for retaining the strap securely in place around the handset. The phone holder also includes a support clip connected to the strap for retaining the handset to a use's waistband. The phone holder may be left in place around the handset during use, carrying, and charging in the base charging unit for the handset, enabled by the unique composition of the strap. The strap may be fabricated of a thin foraminous flexible mesh sheet or a transparent flexible sheet material, which facilitates both viewing and operating the handset keys without removing the invention therefrom.

Ward et. al. U.S. Pat. No. 4,733,776 describes a protective device for a remote control unit includes a resilient, deformable foam panel provided with an arcuate curvature about a central axis, in channel-like fashion. A flexible, transparent elastic member is adapted to extend across the channel opening, with a remote control device disposed within the channel opening. Hook or loop fastener patches are secured to opposed edges of the transparent member and are engageable with like loop or hook fastener patches secured to the outer peripheral surface of the foam panel, so that the transparent member applies tension to the opposed sides of the channel opening and frictionally retains the remote control unit therein. The elasticity of the transparent member permits operation of the pushbuttons of the remote unit, while the foam material cushions the unit and prevents damage from casual impact or falling. Further hook and loop patches may be joined to the outer surface to secure the remote control unit to a table surface or a remote, childproof location.

Abreu-Marston et. al. U.S. Pat. No. 5,938,089 describes a portable liquid container for use while exercising to provide a source of fluid and to enhance the benefits of exercise by increasing the load on selected limbs and muscles. The container comprises a contoured liquid container body and strap assembly for removably securing a container to a user such that one or more containers may be carried by the user while exercising to provide additional weight to enhance the benefits of exercising. The container body includes a flexible concave wall for comfortably conforming to the user's body. The strap assembly includes at least one spare pocket for containing personal articles.

Gormley, et al. U.S. Pat. No. 5,711,469 describes a pouch body (12) used to contain a portable phone utilizes a closure strap (18) to seal the top opening of the pouch with a hook and loop material fastening piece. The phone may be used in the normal manner through the pouch utilizing the flexible transparent window material (38) to view the phone display and activate the phone's keypad. The pouch may be mounted to a belt, strap or any similar sized object using the loop fastener mounting strap (26) with strap adhered to itself (32) attached to hook fastener patch (34). The pouch is also mountable to the sun visor of any vehicle by attaching the pouches loop fastener mounting strap (26) while adhered to hook fastener patch (34) to either the 1st hook attachment strip (42) or 2nd hook attachment strip (46) provided on the expandable mounting band (40).

Klutznick et. al. U.S. Pat. No. 5,526,924 describes a holder for eyewear such as conventional eyeglasses, sunglasses, sports related eyewear and the like is provided. The holder includes a case having a front panel and rear panel which are attached to each other forming a pocket. A top edge of the front panel and the rear panel form an access opening to the pocket. The rear panel includes a flap adapted to fold over and be removably attached to the top portion of the front panel to cover the opening. Straps for attaching the case to a support may be selectively threaded through one or more of a plurality of sets of parallel slits. One of the set of slits extending at right angles to one of the other set of slits so that the straps may extend from the case in different directions. A gripping arrangement is applied to the case to promote the positive positioning of the case relative to the support. A cloth sack is removably attached to the case and disposed within the pocket, the sack being configured to fit about the eyewear. The sack is preferably made of a flexible, strong, soft and washable material, which is particularly suited to the cleaning of the lenses of the eyewear.

Flowers et. al. U.S. Pat. No. 5,433,359 describes a body mountable carrier for carrying a detachable device such as a portable phone, tool, appliance or the like. The carrier has a firm mounting panel to which is attached an elastic strap. The panel and the strap are joined together with mating interlocking fastening materials and can be mounted on an arm with one hand or on a leg. The panel provides a back plane for attachment of the detachable device.

Naymark, et. al. U.S. Pat. No. 5,395,023 describes a multi-purpose carrier having side-by-side compartments for the storing of portable electronic and/or photographic equipment. Successive compartments are fastened together by zipper fasteners so that the side-by-side compartments can be aligned linearly or along an arcuate path or an endless path. An intermediate compartment has a front panel that is extended away from the rear panel so as to expose the front of portable equipment stored in the intermediate compartment. The intermediate compartment has opened sides and an optionally open top. Fasteners on the inner wall of the rear panel and the rear wall of the portable equipment stored in the intermediate compartment to prevent the portable equipment from accidentally falling out of the intermediate compartment.

The prior art teaches communication device holders, and generally holding and carrying items with hook and loop type fasteners known by the registered trademark VELCRO®. However, the prior art does not teach an apparatus made from flexible material that allows the communication device to be inserted and secured in a storage pouch multi-directionally, and that will encase and protect most of the surface area of the communication device while the device is being stored without the need for a top covering flap The present invention fulfills these needs and provides further related advantages as described in the following summary.

SUMMARY OF THE INVENTION

The present invention teaches certain benefits in construction and use which give rise to the objectives described below.

The present invention provides a combination comprising a storage pouch constructed from a single piece of flexible sheet material such as cowhide, folded to form a front panel, left side panel, right side panel, rear panel and a bottom panel, the bottom panel joining the front and rear panels, and the front and rear panels joined at corresponding laterally positioned and spaced apart panel edges. Two surface attachments are fixed to an inside surface of the storage pouch.

A hand-held communication device is an additional part of the combination, this communication device having a front surface, left side surface, right side surface, rear surface and a bottom surface, the communication device adapted by size for fitting into the storage pouch, with a space between the front panel of the storage pouch and the front surface of the communication device, and a space between the rear panel of the storage pouch and the rear surface of the communication device. A second surface attachment means is adapted for joining with the first surface attachment means by contact between the two attachment means, where the second surface attachment means is fixed to the communication device in at least one position corresponding to the first surface attachment means when the communication device is placed into the storage pouch, such that the communication device may be removably fixed to the storage pouch, for securing the communication device in the storage pouch.

A primary objective of the present invention is to provide a communication device holder having advantages not taught by the prior art.

Another objective is to provide an apparatus that can secure a communication device in place without the need for a top cover strap even when the holder is inverted.

A further objective is to provide an apparatus which enables a communication device to be inserted into a holder multi-directionally.

A further objective is to provide an apparatus which can store various types of communication devices, including cellular or portable phones, Walkman™, pagers, or other similar devices.

A further objective is to provide an apparatus which covers all but the top surface of a stored communication device and is therefore open ended enabling easier insertion and withdrawal of the stored device.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
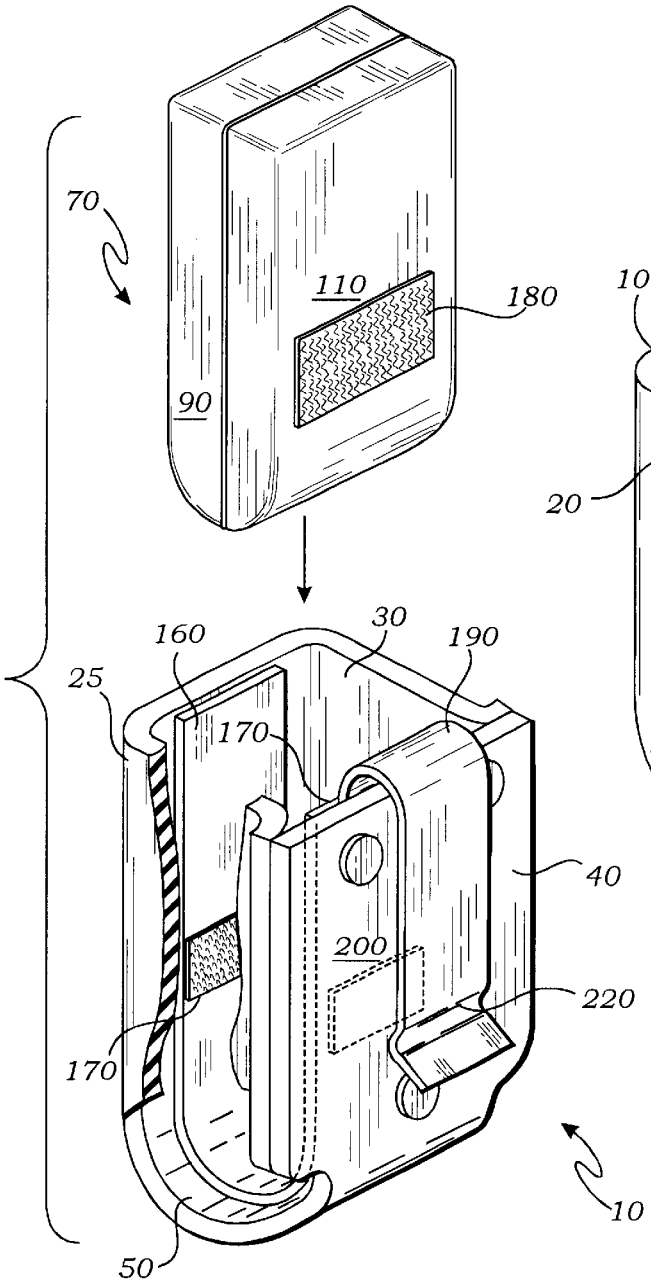
FIG. 1 is a rear perspective view of the preferred embodiment of the present invention, showing a combination hand-held communication device and a storage pouch.
Figure 2:
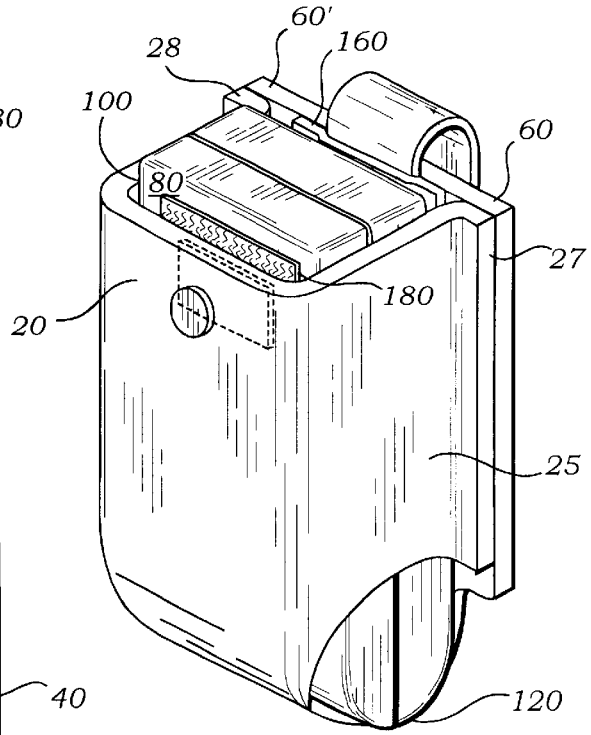
FIG. 2 is a front perspective view of the present invention, showing a hand-held communication device as inserted into the storage pouch.

The above described drawing figures illustrate the invention, a combination comprising a storage pouch 10 constructed from a single piece of a flexible sheet material, preferably cowhide or a leather-like material, folded to form a front panel 20, left side panel 25, right side panel 30, rear panel 40 and a bottom panel 50, the bottom panel 50 joining the front and rear panels 20 and 40, respectively, the front panel 20 and rear panel 40 being joined by the corresponding laterally positioned and spaced apart left side panel 25 and right side panel 30. A left side panel outer edge 27 and a right side panel outer edge 28, preferably bent to form linear flanges, are joined with the rear panel 40 at its outer edges 60 and 60', preferably by means of stitching along the flanges.

The storage pouch 10 is formed so as to carry a hand-held communication device 70 (hereinafter referred to as a "communication device 70"), but which may be any device whatever, having a front surface 80, left side surface 90, right side surface 100, rear surface 110, and a bottom surface 120. The communication device 70 is of a size that will fit into the storage pouch 10, leaving a space between the front panel 20 of the storage pouch 10 and the front surface 80 of the communication device 70, and another space between the rear panel 40 of the storage pouch 10 and the rear surface 110 of the communication device 70.

The communication device 70 could be a cellular or portable phone, a Walkman™, a pager, or other similar device. The right and left side panels 30 and 25, respectively, are flexible enough to admit communication devices 70 that vary in width to some extent.

Fixed against the inside surface of storage pouch 10 is a stiff reinforcing sheet 160 as best shown in FIG. 1, preferably made of thin sheet plastic or metal. The reinforcing sheet 160 helps shape the leather of the storage pouch 10 into a form for accepting the communication device 70 and maintains its rigidity throughout its use. The reinforcing sheet 160 is secured to the interior of the front panel 20 and rear panel 40 with rivets or other common fasteners.

A first surface attachment means 170 is designed to be adhered at the inside surface of the storage pouch 10 and is fixed, preferably, to the reinforcing sheet 160. The first surface attachment means 170 is fabricated for joining with a second surface attachment means 180, which is fixed on one or more of the exterior surfaces 80, 90, 100, 110 of the communication device 70. The second surface attachment means 180 is fabricated for joining with the first surface attachment means 170 when the two come in contact. But the joint between attachment means 170 and 180 is meant to be easily disjoined and rejoined thereafter repeatedly so as to place and replace the communication device 70 within the pouch 10. The second surface attachment means 180 is fixed to the communication device 70 in at least one position corresponding to the first surface attachment means 170 when the communication device 70 is placed into the storage pouch 10, such that the communication device 70 is secured in the storage pouch 10, but may also be removed.

Preferably, the first surface attachment means 170 is a plurality of hooks and the second surface attachment means 180 is a plurality of loops adapted by position and size for being joined to the hooks upon contact between the two, and forming a fastening device similar to that known by the registered trademark VELCRO®.

The first surface attachment means 170 is fixed to at least one of the front 20, side 25 and 30 or rear panels 40 respectively, of the storage pouch 10 in the interior of the pouch, and the second surface attachment means 180 is fixed to at least one of the corresponding front 80, side 90 and 100 or rear 110 surfaces of the communication device 70, so that the surfaces contact each other and join together when the communication device 70 is placed into the storage pouch 10.

The first surface attachment means 170 and the second surface attachment means 180 can be adhered to the corresponding panels on the storage pouch 10 and surfaces of the communication device 70 in several different alternate configurations. In one alternative, the first and second surface attachment means 170 and 180, respectively, are fixed to both the front panel 20 and the rear panel 40 of the storage pouch 10, and to corresponding surfaces of the communication device 70. Also, the first surface attachment means 170 is preferably placed, in one embodiment of the invention at a medial point on one or both opposing interior surfaces of the pouch 10. In an alternate embodiment the first surface attachment means 170 are attached to these surfaces near the upper lip of the pouch 10. Both of these positions are shown in FIG. 1 in the pouch 10. Also, FIG. 1 shows a low position placement of second attachment means 180 on the communication device 70, and this corresponds with the medial positioning of the first surface attachment means 170. Preferably when the communication device 70 is placed into the pouch 10 so that the communication device abuts the bottom panel 50, the second surface attachment means 180, affixed to the communication device 70, is positioned below the first surface attachment means 170, affixed to the interior of pouch 10. When this relationship is realized, it is then possible to pull the communication device 70 part way out of the pouch 10 before the surface attachment means are engaged, so that a firm grip may be obtained on the communication device 70 in order to exert a strong enough manual force to overcome the engaging force of the surface attachment means 170, 180. This is illustrated in FIG. 1.

Alternately, the first and second attachment means 170 and 180, respectively, are fixed to the left and right side panels 25 and 30 respectively, of the storage pouch 10 in laterally opposing positions, and to corresponding surfaces on the communication device 70.

When the fastener surface materials are placed in accordance with the instant description, the apparatus provides the benefit of being able to be upended and shaken while still maintaining the communication device 70 within the pouch 10, i.e., that it will not fall out.

The apparatus is further comprised of a belt clip 190 of a spring-like, somewhat flexible material, preferably aluminum, but alternately, a hard plastic, which is attached to the rear panel 40, preferably on its inner surface by means of rivets or other fasteners, and extends over the top of the rear panel 40 and in adjacency thereto on the outside surface of the rear panel. A space between the rear panel outside surface and the belt clip 190 may be formed so that a belt, clothing item, or other such object (not shown) may be inserted between the belt clip 190 and the rear panel outside surface.

Near its outside distal end, the belt clip 190 may be angled (see numeral 220) so that it contacts the rear panel 40, enabling the pouch 10 to be clamped to a belt. This is best seen in FIG. 1 lower right.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination comprising: a storage pouch constructed from a single piece of flexible sheet material folded to form a front panel, left side panel, right side panel, rear panel and a bottom panel, the bottom panel joining the front and rear panels, the front and rear panels joined by the corresponding laterally positioned and spaced apart left side panel and right side panel; a first surface attachment means fixed to an inside surface of the storage pouch; a hand-held communication device having a front surface, left side surface, right side surface, rear surface and a bottom surface, the communication device adapted by size for conformingly fitting into the storage pouch with a space between at least one of the front panel of the storage pouch and the front surface of the communication device and a the rear panel of the storage pouch and the rear surface of the communication device; a second surface attachment means fixed to an outside surface of the communication device, the second surface attachment means positioned below and not in contact with the first surface attachment means when the communication device is fully inserted within the storage pouch such that said first and second attachment means join when said communication is pulled part-way out of said storage pouch.

2. The apparatus of claim 1 wherein the first surface attachment means is a plurality of hooks and the second surface attachment means is a plurality of loops adapted by position and size for being joined to the hooks upon contact therewith.

3. The apparatus of claim 1 further comprising a resilient belt clip attached to the rear panel and extending in adjacency thereto so as to enable mounting the apparatus on a belt whereby the rear panel and the belt clip are functionally enabled for clamping the belt.

4. The apparatus of claim 1 further comprising a stiff reinforcing sheet fixed against the front, rear and bottom panels of the storage pouch.

5. The apparatus of claim 1 wherein the first surface attachment means is fixed to at least one of the front, side and rear panels of the storage pouch and the second surface attachment means is fixed to a corresponding at least one of the front, side and rear surfaces thereof for enabling contact and joining between the first and second surface attachment means when the communication device is pulled part-way out of the storage pouch.

6. The apparatus of claim 5 wherein the first surface attachment means is fixed to both the front and the rear panels of the storage pouch and the second surface attachment means is fixed to corresponding surfaces on the communication device.

7. The apparatus of claim 5 wherein the first surface attachment means is fixed to the side panels of the storage pouch in laterally opposing positions and the second surface attachment means is fixed to corresponding surfaces on the communication device.

8. A combination comprising: a storage pouch constructed from a single piece of flexible sheet material folded to form a front panel, left side panel, right side panel, rear panel and a bottom panel, the bottom panel joining the front and rear panels, the front and rear panels joined by the corresponding laterally positioned and spaced apart left side panel and right side panel; a first surface attachment means fixed to an inside surface of the storage pouch; a hand-held communication device having a front surface, left side surface, right side surface, rear surface and a bottom surface, the communication device adapted by size for conformingly fitting into the storage pouch; a second surface attachment means fixed to an outside surface of the communication device, the second surface attachment means positioned below and not in contact with the first surface attachment means when the communication device is fully inserted within the storage pouch such that said first and second attachment means join when said communication device is pulled part-way out of said storage pouch.

* * * * *